US009738066B1

(12) United States Patent
Kroon

(10) Patent No.: US 9,738,066 B1
(45) Date of Patent: Aug. 22, 2017

(54) SYSTEM AND METHOD FOR IMAGE DATA PROCESSING FOR INOPERABLE INKJET COMPENSATION IN AN INKJET PRINTER

(71) Applicant: Xerox Corporation, Norwalk, CT (US)

(72) Inventor: Stephen M. Kroon, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/081,057

(22) Filed: Mar. 25, 2016

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC ..... B41J 2/0451; B41J 2/04586
See application file for complete search history.

(56) References Cited

U.S. PATENT DOCUMENTS

| | | | | |
|---|---|---|---|---|
| 6,484,631 | B2 | 11/2002 | Degani et al. | |
| 7,110,144 | B2 | 9/2006 | Cheng et al. | |
| 7,239,819 | B2 | 7/2007 | Gross et al. | |
| 7,283,282 | B2 | 10/2007 | Sanger et al. | |
| 7,457,015 | B2 | 11/2008 | Snyder et al. | |
| 8,042,899 | B2 | 10/2011 | Folkins et al. | |
| 8,085,433 | B2 | 12/2011 | Arachchige et al. | |
| 8,150,283 | B2 | 4/2012 | Hosier | |
| 8,335,387 | B2 | 12/2012 | Bernal et al. | |
| 8,376,503 | B1 | 2/2013 | Wu et al. | |
| 8,387,819 | B2 | 3/2013 | Chu et al. | |
| 8,432,582 | B2 | 4/2013 | Zhang et al. | |
| 8,437,040 | B2 | 5/2013 | Taylor et al. | |
| 8,531,743 | B2 | 9/2013 | Wu et al. | |
| 9,463,638 | B1 * | 10/2016 | Kroon | B41J 2/0451 |
| 2005/0099446 | A1 | 5/2005 | Mizes et al. | |
| 2005/0134624 | A1 | 6/2005 | Mizes | |
| 2007/0035748 | A1 | 2/2007 | Zhang et al. | |
| 2007/0139733 | A1 | 6/2007 | Mizes et al. | |
| 2009/0109450 | A1 * | 4/2009 | Shino | B41J 2/155 358/1.8 |
| 2010/0220363 | A1 | 9/2010 | Paul et al. | |
| 2012/0075370 | A1 * | 3/2012 | Ramakrishnan | B41J 2/04508 347/10 |
| 2013/0265352 | A1 | 10/2013 | Burress et al. | |
| 2014/0035981 | A1 | 2/2014 | Burress et al. | |

* cited by examiner

*Primary Examiner* — Alessandro Amari
*Assistant Examiner* — Roger W Pisha, II
(74) *Attorney, Agent, or Firm* — Maginot Moore & Beck LLP

(57) ABSTRACT

A method of compensating for an inoperable inkjet in a printer includes applying a first modification to a first swath of image data that includes a raster corresponding to the inoperable inkjet in image data of a printed image. The method also includes applying a plurality of modifications to a plurality of swaths in the image data to generate a plurality of modified swaths in the image data, where each swath in the plurality of swaths includes a plurality of rasters that do not include the raster corresponding to the inoperable inkjet. The method further includes forming a printed image based on the modified swaths of image data to compensate for an inoperable inkjet in the printer.

14 Claims, 9 Drawing Sheets

SYSTEM AND METHOD FOR IMAGE DATA PROCESSING FOR INOPERABLE INKJET COMPENSATION IN AN INKJET PRINTER

TECHNICAL FIELD

This document relates generally to digital imaging systems, and more particularly, to inkjet imaging systems that compensate for inoperable inkjets during a printing operation.

BACKGROUND

Drop on demand inkjet technology for producing printed media has been employed in commercial products such as printers, plotters, and facsimile machines. Generally, an inkjet image is formed by selectively ejecting ink drops onto an image receiving surface from a plurality of inkjets, which are arranged in one printhead or an array of printheads. For example, in some embodiments an image receiving member with an image receiving surface moves relative to the printheads and a controller operates individual inkjets in the printheads to eject ink drops at appropriate times based on image data to form a printed image in the image receiving surface. In some embodiments, the image receiving surface is the surface of a drum or endless belt that transfers a latent ink image received from the inkjets in the printhead array to a paper substrate or other suitable print medium. In other embodiments, the inkjets in the printheads eject drops of ink directly onto the surface of the print medium.

During operation of the printer, some inkjets may become inoperable and fail to eject ink drops in a reliable manner. An inoperable inkjet produces a noticeable streak extending along a length of the printed image in locations where the inkjet would have printed ink drops if the inkjet was operating normally. Prior art inkjet printers employ compensation techniques to reduce the visibility of these streaks. For example, FIG. 8 depicts a sample of contone image that compensates for two inoperable inkjets. The image data includes streaks that correspond to the locations of two inoperable inkjets in groups 804 and 808. FIG. 8 depicts a total of six streaks because in the embodiment of FIG. 8 the printer generates an image using three passes of the inkjets, including the inoperable inkjets, with a cross-process direction translation of the printheads between passes. Each of the streaks is arranged along a raster of the image data corresponding to a location of the inoperable inkjets. The compensation process adjusts the contone image data for a predetermined number of columns of image data on either side of the streaks, which enables neighboring inkjets in the printer to compensate for the inoperable inkjets and produce printed images that reduce or eliminate the visual impact of the streaks from the inoperable inkjets.

One deficiency of the image data compensation technique depicted in FIG. 8 is that the adjusted contone image data in the regions around the inoperable inkjet that compensates for the local streak defect also changes the distribution of ink drops that form the printed image after the printer performs a halftone conversion operation using the adjusted contone image data. Using different combinations of ink drops to form similar colors on different parts of a single printed image has the potential to produce irregularities in the perceived colors in different regions of a single image. Consequently, improvements to the operation of inkjet printers that compensate for inoperable inkjets would be beneficial.

SUMMARY

In one embodiment, a method for operating an inkjet printer to compensate for an inoperable inkjet has been developed. The method includes identifying with a controller an inoperable inkjet in a printhead, identifying with the controller a first raster in image data corresponding to the inoperable inkjet in the printhead, applying with the controller a first modification to the image data in a first swath of the image data to generate a first modified swath in the image data to compensate for the inoperable inkjet in a printed image, the first swath including the first raster corresponding to the inoperable inkjet and a plurality of rasters in a region of the image data around the first raster, applying with the controller a plurality of modifications to each swath in a plurality of swaths in the image data to generate a plurality of modified swaths in the image data, each swath in the plurality of swaths including a plurality of rasters that do not include the raster corresponding to the inoperable inkjet, and operating with the controller a plurality of inkjets in the printhead with reference to the image data including the first modified swath and the plurality of modified swaths to form a printed image on an image receiving surface.

In another embodiment, an inkjet printer that is configured to compensate for an inoperable inkjet has been developed. The inkjet printer includes at least one printhead including a plurality of inkjets, an image receiving member having an image receiving surface configured to receive ink ejected from the plurality of inkjets in the at least one printhead, a memory, and a controller operatively connected to the at least one printhead and the memory, The memory is configured to store image data corresponding to an image to be printed on the image receiving member and a plurality of tone reproduction curves (TRCs). The controller is configured to identify an inoperable inkjet in the plurality of inkjets in the at least one printhead, identify a first raster in the image data stored in the memory corresponding to the inoperable inkjet in the printhead, apply a first modification to the image data in a first swath of the image data to generate a first modified swath in the image data to compensate for the inoperable inkjet in a printed image, the first swath including the first raster corresponding to the inoperable inkjet and a plurality of rasters in a region of the image data around the first raster, apply a plurality of modifications to each swath in a plurality of swaths in the image data to generate a plurality of modified swaths in the image data, each swath in the plurality of swaths including a plurality of rasters that do not include the raster corresponding to the inoperable inkjet, and operate a plurality of inkjets in the printhead with reference to the image data including the first modified swath and the plurality of modified swaths to form a printed image on an image receiving surface.

BRIEF DESCRIPTION OF THE DRAWINGS

The foregoing aspects and other features of an inkjet printer that compensates for inoperable inkjets are explained in the following description, taken in connection with the accompanying drawings.

DETAILED DESCRIPTION

Figure 1:
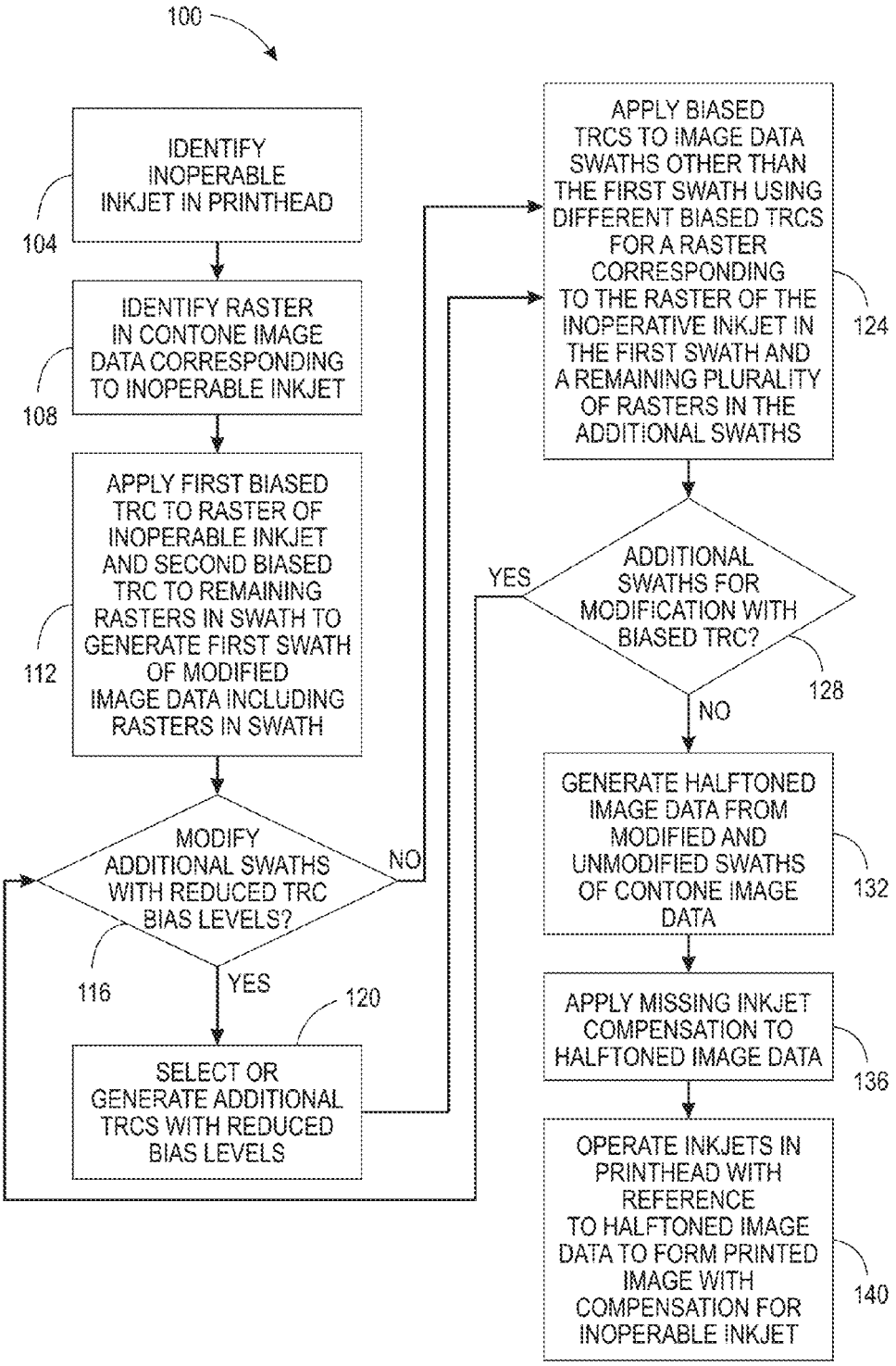
FIG. 1 is a block diagram of a process for applying biased tone reproduction curves (TRCs) to swaths of contone image data to compensate for one or more inoperable inkjets in a printhead of an inkjet printer.

For a general understanding of the environment for the device disclosed herein as well as the details for the device, reference is made to the drawings. In the drawings, like reference numerals designate like elements. As used herein, the words "printer" and "imaging device," which may be used interchangeably, encompass any apparatus that forms an image with marking material on media for any purpose, such as a digital copier, bookmaking machine, facsimile machine, a multi-function machine, or the like. As used herein, the term "inkjet" refers to a component that ejects drops of ink onto an image receiving surface in a printer. An inkjet printhead includes at least one inkjet and typically includes a two-dimensional array of inkjets that eject drops of ink in predetermined patterns to form a printed image on an image receiving surface. The image receiving surface is, for example, a piece of paper or other print medium in a direct marking printer or a rotating drum or endless belt in an indirect marking printer. In the indirect marking printer, the imaging receiving drum or belt receives a latent ink image from one or more printheads, and the printer then transfers the latent ink image to paper or another suitable print medium.

As used herein, the term "process direction" (P) refers to a direction of relative movement between a printhead and an image receiving surface that receives drops of ink ejected from one or more inkjets in the printhead. As used herein, the term "cross process direction" (CP) refers to an axis that is perpendicular to the process direction. An array of inkjets in one or more printheads extends along the cross-process direction to form all or a portion of a printed image. An inoperable inkjet that fails to eject ink drops forms a linear streak extending in the process direction on the image receiving surface in locations that do not receive ink drops from the inoperable inkjet.

As used herein, "inoperable inkjets" include "malfunctioning inkjets," "missing inkjets," and refer to any inkjets in a printer that fail to eject ink drops in an appropriate manner based on the specifications of the printer. For example, some inoperable inkjets become clogged with dried ink or other debris and fail to eject any ink drops. Other inoperable inkjets eject ink drops only intermittently or eject ink drops onto incorrect locations on the image receiving surface. The term "missing raster" refers to a raster column corresponding to an inoperable inkjet. In a multi-pass printer, a single inoperable inkjet produces a missing raster column for each pass of the printhead past the image receiving surface. Of course, the "missing" raster or multiple missing rasters are still present in the image data, but the inoperably inkjet cannot print ink drops based on the original contone and corresponding halftoned image data for the missing rasters during operation of the printer.

As used herein, the term "pixel" refers to a single location in two-dimensional image data that is assigned a contone or halftoned value. Pixels are often referenced using coordinates in a two-dimensional plane. In multi-color images, a single pixel can be assigned values corresponding to each color that is used in the printing process, such as cyan, magenta, yellow, and black (CMYK) values or values for different colors in multi-color printers. Some image processing techniques decompose a multi-color image into a set of monochrome images for each color, which are referred to as color separations. For example, in a CMYK printer a multi-color image is decomposed into a four color separations that each include a two-dimensional array of pixels where the value of each pixel corresponds to an intensity level of the particular color separation at a predetermined location in the two-dimensional image. As used herein, the term "raster" refers to a set of pixels in the image data that each correspond to portions of a printed image that are formed by ink drops ejected from a single inkjet in a printhead. While the examples presented herein often depict a single raster of image data corresponding to a single inkjet in a printhead for simplicity, in many practical embodiments multiple rasters of image data correspond to at least a portion of the physical area that is covered by ink drops from a single inkjet. The systems and methods described herein are applicable to any of these printer and image data configurations.

As used herein, the term "swath" refers to a group of rasters in the image data that a controller in the printer modifies in a predetermined manner to reduce the visual impact of one or more inoperable inkjets in a printed image that the printer forms based on the modified image data. As described in more detail below, a printer modifies the contone image data associated with a swath of rasters that includes at least one raster associated with an inoperable inkjet and the printer further modifies additional swaths of image data that do not include the rasters corresponding to the inoperable inkjet to reduce the visual impact of the inoperable inkjet on the color uniformity of the printed image. Multiple swaths in the image data do not necessarily have to be fully contiguous and different swaths optionally include different numbers of rasters. Furthermore, a raster may be included in two or more overlapping swaths.

As used herein, the terms "contone image data," "contone levels," and "contone values" each refer to image data pixels that store information corresponding to a continuous-tone (contone) color level for one or more colors in a printed image. The term continuous-tone refers to a theoretically infinite range of values between a minimum level (e.g. complete absence of a particular color from a pixel) to a maximum value (e.g. a predetermined maximum presence of the color within the pixel). Practical image processing and printing systems represent contone image data over a discrete range of values that approximate the theoretically infinite number of levels between the minimum and maximum values. For example, some printers use 8-bit, 10-bit-, and 16-bit representations of each color, which correspond to 32-bit, 40-bit, and 64-bit representations, respectively, for each contone pixel representing all four colors in a CMYK printer. For explanatory purposes, contone values are referenced on a floating-point scale of 0.0 to 1.0 in this document.

However, those of skill in the art will recognize that contone values are often referred to as percentages (0%-100%), as discrete integer values (e.g. 0-255 for an 8-bit representation), or using any other suitable numeric representation.

As used herein, the term "tone reproduction curve" (TRC) refers to a data structure that is stored in a memory of a printer to enable the printer to translate an input contone image datum to an output contone image datum that is adjusted to reflect the physical characteristics of the printer for accurate color reproduction in a physical printed document. In one embodiment, the TRC is embodied at a lookup table (LUT) that is stored in the memory using a suitable data structure, such as a one-dimensional array. Each entry in the LUT corresponds to one point in the tone reproduction curve that maps the input contone datum value in the device independent color space to an output contone datum value in the device dependent color space for the printer. The numeric value of the input contone level value is an index that corresponds to one entry in the LUT, and the numeric value of the LUT entry corresponds to an output contone level value in a device-specific color space for the printer. Many printers use multiple TRCs both for different color separations in color printers and in multiple color separations within each ink color that the printer uses to form printed images. For example, a cyan, magenta, yellow, black (CMYK) color printer uses at least one TRC for each of the CMYK colors.

As used herein, the term "biased tone reproduction curve" refers to a tone reproduction curve that deviates from a "neutral" curve where an input contone value maps to a device specific equivalent output contone value. In different TRCs the bias may be positive to increase the output contone level for a given input contone level compared to a neutral TRC or the bias may be negative to decrease the output contone level for a given input contone level. As used herein, a reference comparing the bias level of one TRC to another TRC refers to the bias level in terms of absolute value. Thus, a first positive bias level that is greater than a second positive bias level indicates that the TRC with the first positive bias level generates an output contone value that is greater than the output contone value of the TRC with the second positive bias level, while a first negative bias level that is greater than a second negative bias level indicates that the TRC with the first negative bias level generates an output contone value that is less than the output contone value of the TRC with the second negative bias level.

As described in more detail below, a printer uses one or more TRCs with a positive bias to increase the contone levels of inkjets in a swath of rasters that surround the raster of an inoperable inkjet to compensate for the missing ink drops that the inoperable inkjet fails to emit during operation. Additionally, the printer uses a negatively biased TRC for the rasters that corresponds to the inoperable inkjet since the inoperable inkjet is disabled within the printhead hardware and does not eject ink drops during the printing process. As used herein, the terms "bias level" or "level of bias" are used interchangeable with regards to TRCs and refer to an amount of deviation between the biased TRC and a neutral TRC over different portions of the biased TRC. The bias level affects the degree to which a printer modifies contone image data values for different rasters across multiple swaths of the image data to compensate for inoperable inkjets.

As used herein, the terms "halftoned image data" and "halftoned pixels" each refer to image data pixels that store information corresponding to data used to produce a halftone printed image. In an inkjet printer, halftoned image data include a two-dimensional array of pixels where each pixel has a binary value of, for example, 0 or 1 to indicate that an individual inkjet should not print an ink drop in a given location (0) or should print an ink drop in the given location (1). Since an inkjet printer cannot produce a large range of colors corresponding to each contone pixel, the printer instead produces halftoned patterns of printed ink drops that the human eye perceives as reproducing the original contone color. CMYK inkjet printers generate four sets of overlapping halftoned data for each of the cyan, magenta, yellow, and black colors. Because halftoned image data is formed from pixels that have one of two potential values, the halftoned image data are also referred to as binary image data, and the two-dimensional binary image data correspond to the physical locations of printed ink drops in a printed image. Inkjet printers print discrete drops of ink that form halftoned printed images, and in many operating configurations the final halftoned physical printed image is based on digital contone image data that the printer receives as input. During operation of a printer, a digital controller first processes the contone image data, which is described in more detail herein, and then performs a halftoning operation that converts the processed contone image data to halftoned image data. The printer optionally performs additional processing of the halftoned image data to generate the final set of halftoned image data that the printer uses to control the operation of the individual inkjets in the printer to form a printed image.

Figure 6:
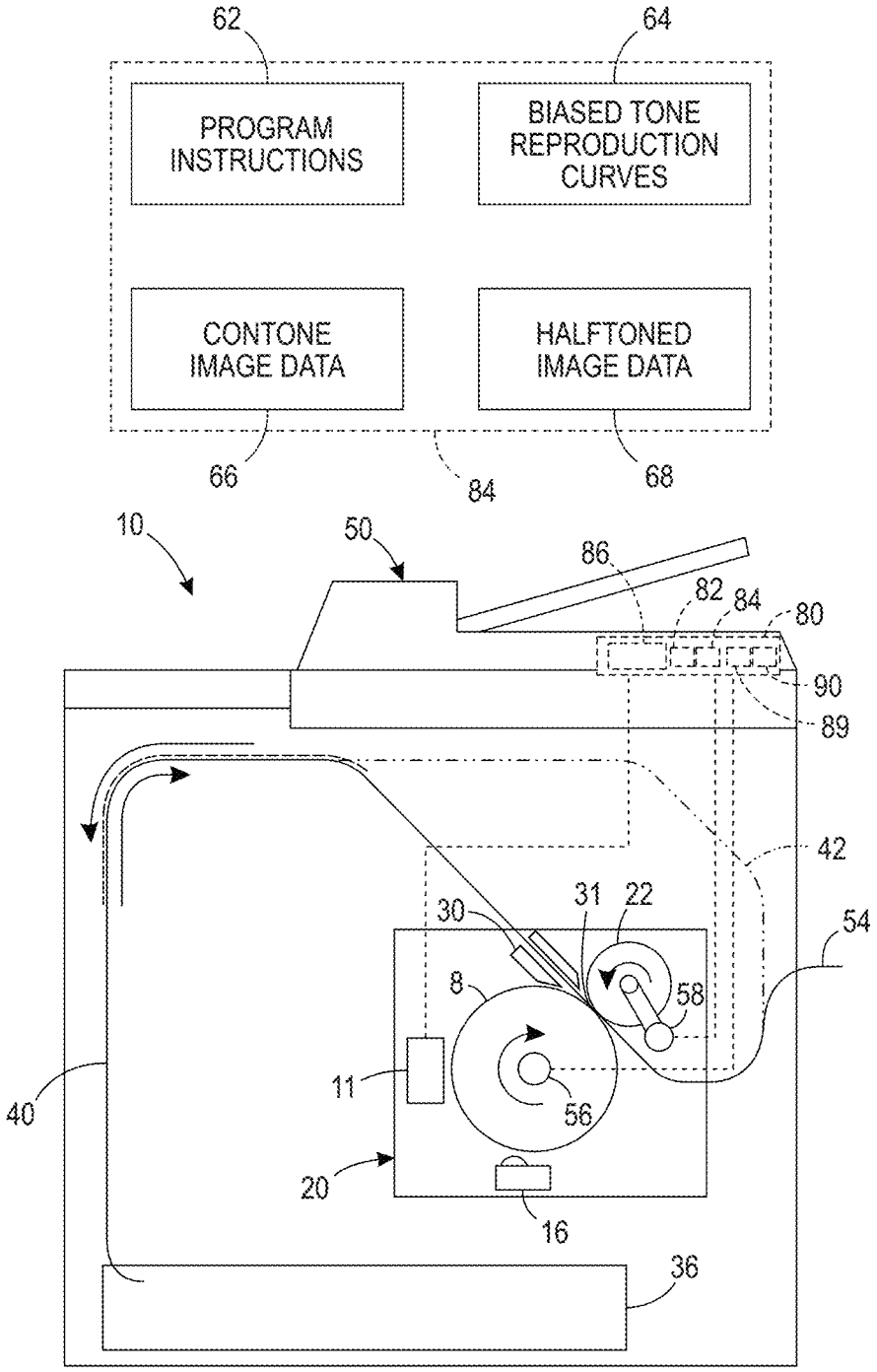
FIG. 6 is a diagram of an inkjet printer that is configured to perform the processes of FIG. 1 and FIG. 2.

FIG. 1 depicts a process 100 that an inkjet printer performs to compensate for one or more inoperable inkjets during a printing operation. The process 100 refers to the operation of an inkjet printer, and FIG. 6 depicts an illustrative embodiment of an inkjet printer 10 that is configured to perform the process of FIG. 1. Although the system and method are discussed in the context of a raster interlaced multiple pass inkjet printer, they may be used with other digital image marking and presentation systems including non-interlaced single-pass multi-function printers and systems that use other types of marking agents and transfer methods, such as electrostatically transferred toners, and other forms of liquid ink, such as aqueous, emulsified gel, or UV curable inks and more generally may be applicable to any digital image display system employing data flow and processing analogous to the systems and processes described, including digital image forming systems emitting light such as emissive displays. The printer 10 of FIG. 6 is configured to form ink images on an imaging drum 8 using a print mode implemented with a ten raster interlace for a prudent maximum of ten rasters per swath.

The printer 10 includes a media supply unit 36, media supply path 40, duplex media path 42, media finisher 54, controller 80, and an imaging unit 20. The imaging unit 20 includes an imaging drum 8, imaging drum actuator 56, marking unit 11, drum maintenance unit 16, transfix roller 22, transfix actuator arm 58, and preheater 30. The marking unit 11 includes one or more inkjet printheads that eject ink drops onto the imaging drum 8 to form the ink images using the print mode described above. The marking unit 11 optionally includes multiple printheads that eject drops of inks having various colors to form multi-color images. In one configuration, the marking unit 11 ejects inks having cyan, magenta, yellow, and black (CMYK) colors that combine to form multi-color images. Other suitable printer embodiments print monochrome images or use different combinations of colorants than CMYK inks. Different inkjet printer configurations use solvent-based inks, aqueous inks, UV curable inks, gel inks, phase-change inks, and any other form of ink that is suitable for use in inkjet printing.

The marking unit 11 forms images on the surface of the imaging drum 8 as the imaging drum 8 rotates past the marking unit 11. An actuator 56 rotates the imaging drum 8 past the marking unit 11 multiple times as the marking unit 11 ejects ink drops to form ink images on the drum. In some printer embodiments, the actuator 56 rotates the imaging drum 8 at a higher angular velocity while the marking unit 11 forms ink images on the imaging drum 8 than during transfix operations when the ink images are transferred to media sheets. The imaging drum 8 is configured to receive and hold ink images that are transfixed to media sheets passing through a nip formed between the imaging drum 8 and the transfix roller 22. Prior to forming latent images on the imaging drum 8, the drum maintenance unit 16 applies a coating of release agent to the surface of the imaging drum 8. The release agent is a chemical, such as silicone oil, that prevents latent ink images formed on the imaging drum from adhering to the imaging drum 8 instead of transfixing to the media sheets. The ink in the ink images floats on the layer of release agent prior to being transferred to the media sheet.

Transfix roller 22 is configured to apply pressure to a media sheet as the media sheet contacts the imaging drum 8 to transfer a latent ink image formed on the imaging drum 8 to the media sheet. The transfix roller 22 is movable between a position where the transfix roller 22 engages the imaging drum 8 to form a nip 31, and a second position where the transfix roller 22 is removed from engagement with the imaging drum 8. Printer 10 includes an actuator arm 58 that moves the transfix roller between the two positions. The actuator arm 58 moves the transfix roller 22 out of engagement with the imaging drum 8 during image formation as the marking unit 11 forms ink images on the imaging drum 8, and moves the transfix roller 22 into engagement with the imaging drum 8 to transfix the ink images on media sheets. The transfix roller 22 is not directly connected to a motor that rotates the transfix roller 22, but the transfix roller 22 rotates as the imaging drum 8 rotates when engaged to the imaging drum 8.

In the printer 10, an electronic controller 80 controls the operation of the various subsystems, components and functions of the printer 10. In the illustrative embodiment of the printer 10, the controller 80 is an electronic subsystem (ESS) 80. The controller 80 is a self-contained, dedicated mini-computer having a central processor unit (CPU) 82 with one or more digital memory devices 84, which include random access memory (RAM) and non-volatile memory such as solid-state or magnetic disks, and a display or user interface (UI) 86. The ESS or controller 80, for example, includes a sensor input and pixel placement control circuit 89. In addition, the CPU 82 reads, captures, prepares, and manages the image data flow between image input sources, such as scanning system 50, or an online or a work station connection 90, and the marking unit 11. As such, the ESS or controller 80 is the main multi-tasking processor for operating and controlling all of the other machine subsystems and functions.

In the printer 10, the controller 80 is implemented with general or specialized programmable processors that execute programmed instructions. The instructions and data required to perform the programmed functions may be stored in memory associated with the processors or controllers. The processors, their memories, and interface circuitry configure the controllers to perform the image data processing, which is described more fully below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Multiple controllers configured to communicate with a main controller 80 may also be used.

The controller 80 reads and writes data that are stored in the memory 84. In the configuration of FIG. 6, the memory 84 stores program instructions 62 that the controller 80 executes to perform the operations described herein. The memory 84 also stores data corresponding to the biased tone reproduction curves 64, which include both TRCs with a positive bias and TRCs with a negative bias that the controller 80 uses to modify the rasters in multiple swaths of contone image data. The memory 80 also stores contone image data 66 for an image that the printer 10 forms on the imaging drum 8. The contone image data 66 optionally include multiple sets of contone image data for a single image including contone image data in device independent and device-dependent color spaces, and modified contone image data that the controller 80 generates to compensate for one or more inoperable inkjets in the marking unit 11. The memory 84 also stores halftoned image data 68. During operation, the printer 10 receives and processes contone and halftoned image data for a wide range of printed images including text, graphics, and the like. The printer 10 uses a predetermined set of TRC bias curves 64 to process different images during operation. The TRC bias curves 64 do not depend on the specific contents of any given set of image data. The specific per-raster TRC bias applied is determined according to the raster's position within a modified raster swath positioned relative to an inoperative raster. As described in more detail below, the controller 80 generates the halftoned image data for operation of the inkjets in the marking unit 11 based on modified contone image data 66 to enable the marking unit 11 to compensate for one or more inoperable inkjets during a printing operation.

The controller 80 is operatively connected to various components in the printer 10, including the marking unit 11, imaging drum actuator 56, and transfix roller actuator arm 58. The CPU 82 in controller 80 obtains programmed instructions from the electronic storage 82 and executes the programmed instructions to perform various operations in the printer 10. The controller 80 operates the transfix actuator arm 58 to move the transfix roller 22 in and out of engagement with the imaging drum 8. The controller 80 also operates the imaging drum actuator 56 to rotate the imaging drum at one or more rotational velocities. The controller 80 also operates the marking unit 11 to form ink images on the imaging drum 8, and operates the media paths 40 and 42 to control the movement of media sheets through the printer 10.

While FIG. 6 depicts a multi-pass indirect inkjet printer for illustrative purposes, the processes described herein are also suitable for use with different inkjet printer configurations. In particular, in an interlaced multi-pass printer configuration a single inoperable inkjet produces a different artifact in the printed image during each pass (e.g. streaks at three different positions in a three-pass interlaced printer configuration). Since most printers with interlaced printing operations move the printhead by a predetermined distance in the cross-process direction for each pass, the artifacts have a predetermined spatial frequency that corresponds to the distance of movement for the printhead. The repeated artifacts increase the perceptible impact of a single inoperable inkjet in a multi-pass printer. However, single-pass indirect inkjet printers and direct-to-media inkjet printers are also suitable for use with the processes described below.

Referring again to FIG. 1, during the process 100 an inkjet printer performs a printing operation with compensation for one or more inoperable inkjets. In the discussion below, a reference to the process 100 performing a function or action refers to the operation of a controller to execute stored program instructions to perform the function or action in association with one or more components in an inkjet printer. The process 100 is described in conjunction with the printer 10 of FIG. 6 for illustrative purposes.

Process 100 begins as the controller 80 identifies at least one inoperable inkjet in one printhead or an array of printheads in the printer 10 (block 104). In some printers, the controller 80 receives scanned image data of predetermined printed test patterns that include printed marks from each of the inkjets in the marking unit 11. The controller 80 identifies one or more inoperable inkjets in response to identifying missing marks in the scanned image data. Some printer embodiments include an optical scanner within the printer that generates scanned image data of the image receiving surface, such as the surface of the imaging drum 8 in the printer 10, while other printer embodiments receive scanned image data from an external optical scanner such as a flatbed scanner or other suitable device. In some embodiments the identification of inoperable inkjets occurs prior to the commencement of additional printing operations.

Process 100 continues as the controller 80 identifies a raster in contone image data that corresponds to an inoperable inkjet (block 108). The controller identifies rasters of contone image data including a series of pixels that are arranged in the process direction based on the cross-process direction location of the identified inoperable inkjets. Since the printheads in the marking unit 11 include a predetermined array of inkjets with fixed relative positions in the cross-process direction, the controller 80 uses the predetermined locations of the inoperable inkjets to identify the rasters of inoperable inkjets in the image data. In situations where the controller 80 identifies multiple inoperable inkjets, the controller also identifies a raster in the image data that corresponds to each inoperable inkjet. Using FIG. 3 as an example, a sample image 300 includes a missing raster 304. The image 300 also includes a number of other rasters that appear similar to the raster 304 due to the application of biased TRCs that is discussed in more detail below during process 100. The sample image is formed as a gradient from highest contone level (100%) to lowest contone level (0%) for illustrative purposes, but the process 100 is applicable to any arrangement of contone image data that the printer 10 receives during operation.

Figure 2A:
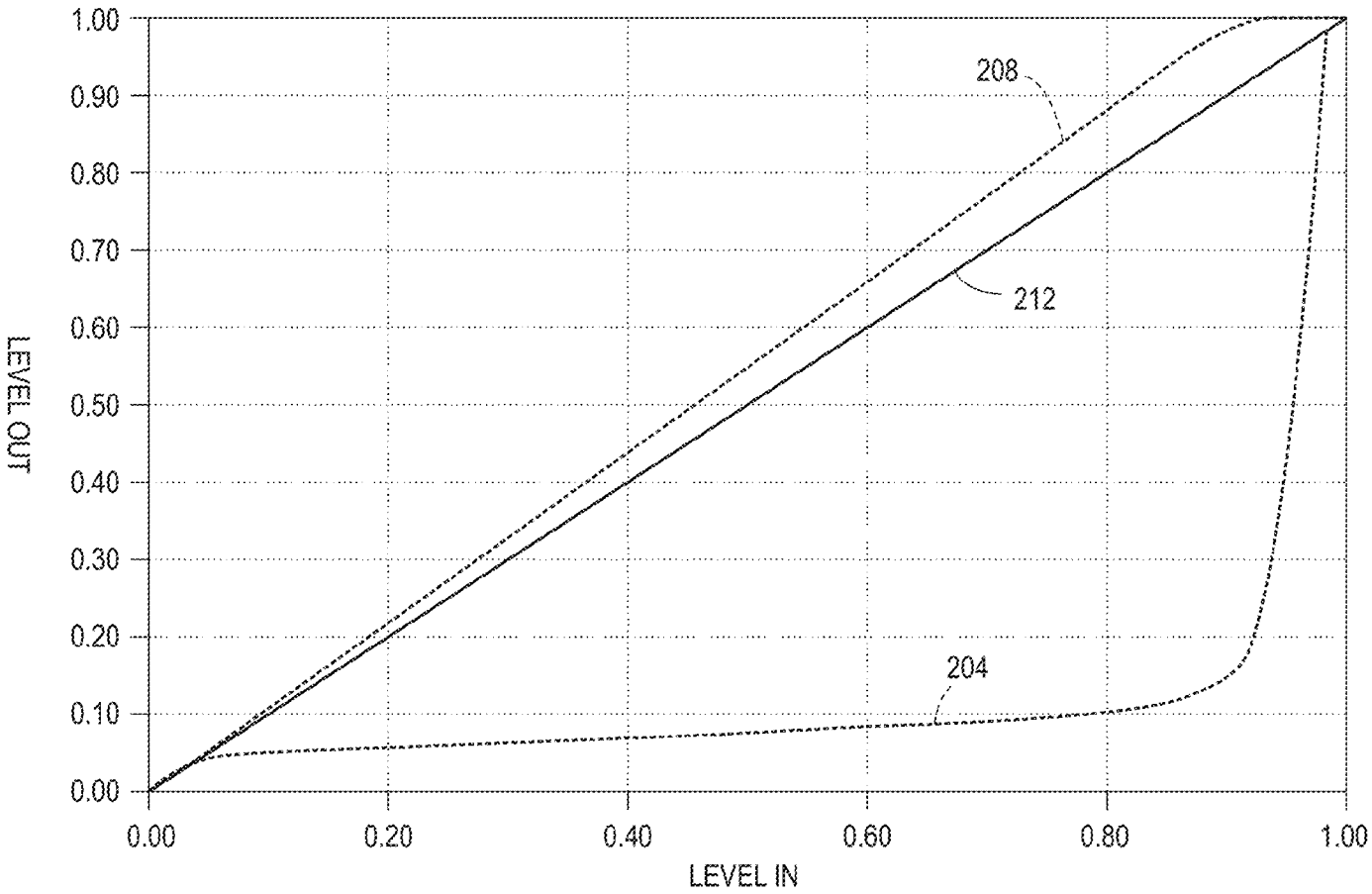
FIG. 2A is a diagram depicting illustrative examples of biased TRCs that are used in the process of FIG. 1.

Process 100 continues as the controller 80 applies a first biased TRC to a first raster that corresponds to the inoperable inkjet and applies a second biased TRC to a predetermined number of rasters surrounding the first raster in a swath of the image data (block 112). In the examples provided herein, each swath is a total of ten pixels in width in a printer that performs multiple passes with a cross-process direction offset of ten pixels for each pass. However, in alternative embodiments the number of rasters that form each swath can be larger or smaller based on the size of the cross-process direction offset of the printhead or based on an empirically determined swath width. In particular, in single-pass printing systems where swath width is not constrained by the raster interlace period, the size of swaths may be determined based on spatial frequency for repetition of the contone image data modification process. In some instances, a comparatively high spatial frequency reduces the perceptible impact of the swaths that include inoperable inkjets on the final printed images. Furthermore, while the illustrative embodiments include swaths of uniform sizes, alternative embodiments include swaths with varying numbers of rasters, FIG. 2A depicts a graph 200 with examples of biased TRCs that are suitable for use with the process 100. In FIG. 2A the axis labeled "Level In" corresponds to the input contone value of pixels of contone image data, and the axis "Level Out" refers to an output contone value that matches each of the input contone values along one of the TRCs 204, 208, and 212. The TRC 212 is a "neutral" TRC that maps each output contone value to a value matching the corresponding input contone value in a one-to-one manner, while the TRC 204 has a negative bias and TRC 208 has a positive bias. In many embodiments, the positively biased TRCs produce a net increase in the perceived density of the modified image data that is equal to the perceived decrease in the perceived density of the modified image data due to the negatively biased TRCs. Of course, the numeric sum of values of the biased TRCs shown in FIG. 2A and FIG. 2B do not simply reproduce the neutral TRC for at least two reasons. First, each positively biased TRC is applied to a relatively large number of rasters in comparison to the negatively biased TRC, such as nine rasters in a swath receiving the positively biased TRC while only one raster receives the negatively biased TRC in the simplified examples above, although the precise ratio differs based on the number of rasters in different swaths. Second, the human eye does not perceive changes to the density of printed images in a perfectly linear manner. Instead, the positively and negatively biased TRCs are selected based on empirical models for the perceptibility of different densities of ink and the specific bias levels of TRCs may vary between different models of printer.

Figure 2B:
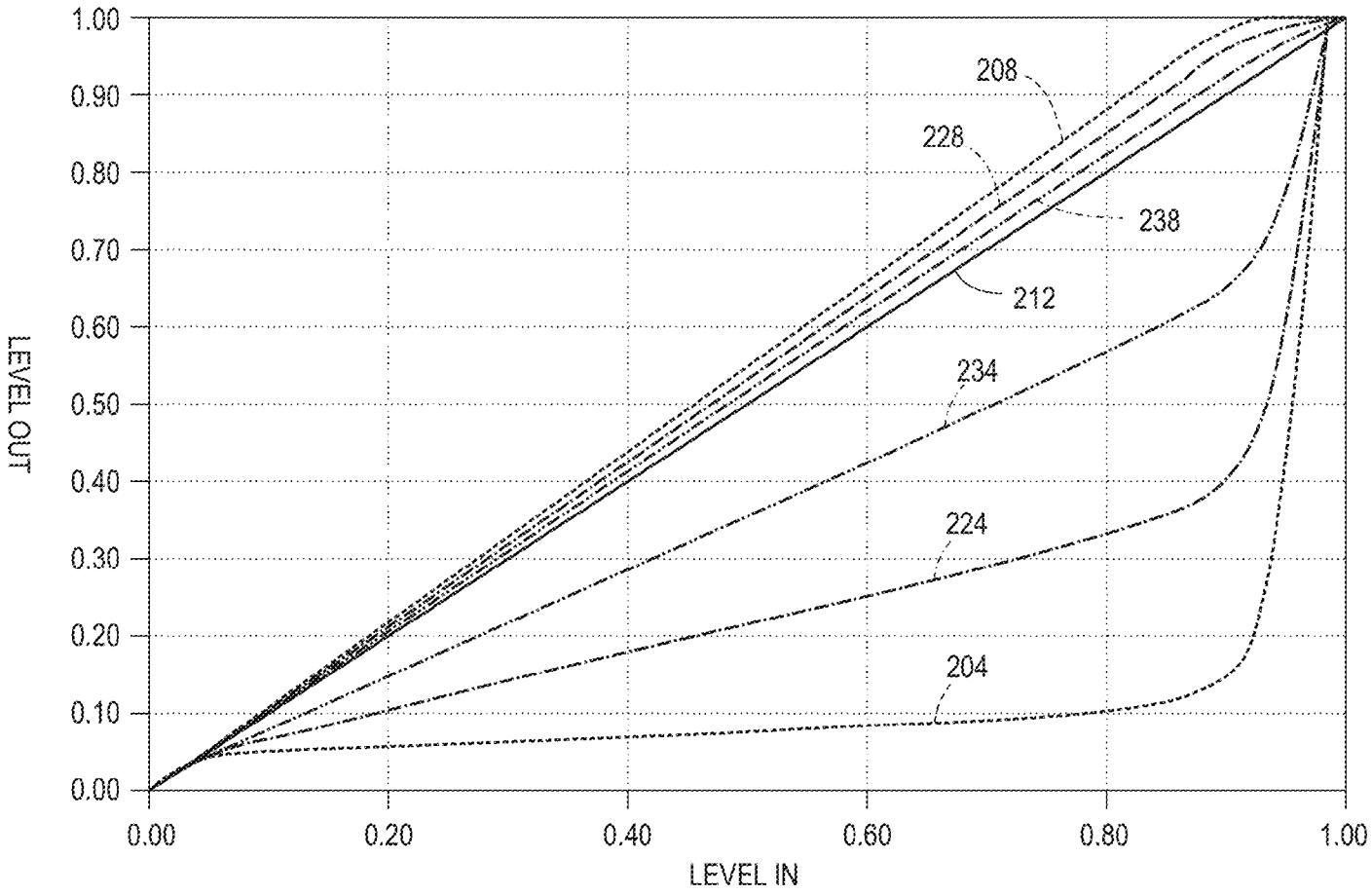
FIG. 2B is a diagram depicting illustrative examples of biased TRCs with multiple bias levels that are used in the process of FIG. 1.

In other embodiments, the original TRC does not necessarily need to be a neutral TRC and negatively and positively biased TRCs may be based upon another nominal TRC. Additionally, many printers apply multiple different TRCs to contone image data during a printing operation and the controller 80 optionally applies the biased TRCs depicted in FIG. 2A and FIG. 2B to image data in addition to other TRCs during a printing operation. Furthermore, while FIG. 2A and FIG. 2B depict different TRCs for use in modification of the contone image data where each TRC corresponds to one color in a potentially multi-color printer, an alternative embodiment employs biased vector color mappings that modify multiple the contone image data for multiple color separations in tandem instead of using TRCs with varying bias levels for individual colors. The printer 10 and the process 100 are equally suited for modification of image data using biased multi-dimensional color vector mappings or other techniques that are known to the art for adjusting the density levels of contone image data.

The controller 80 applies the negatively biased TRC 204 to the image data in the raster that corresponds to the inoperable inkjet. The negatively biased TRC 204 effectively reduces the density of image data in the entire raster corresponding to the inoperable inkjet to a degree that is determined by the original input contone level mapped to the output level of the negatively biased TRC 204. However, the negatively biased TRC 204 does not merely map all input contone levels to a minimum value of 0.0, even though the inoperable inkjet does not participate in a printing operation for at least two reasons. First, the non-zero mapping for otherwise correctable input levels allows the printer 10 to optionally perform additional compensation processes for the inoperable inkjet on a per page basis after generating the halftoned image data from the modified contone image data. Thus, the negatively biased TRC 204 still preserves non-zero contone output levels for many of the input levels.

A second reason for the shape of the negatively biased TRCs, and particularly for higher input levels such as levels in a range of 0.9 to 1.0 in the example of FIG. 2A, which are generally greater than the maximum level correctable by inoperable inkjet compensation, is that the non-zero mapping in the negatively biased TRC 204 provides swath density conservation when applied to swaths of working rasters. The maximum correctable level is primarily a function of swath width. It occurs at input levels where swath rasters positively biased according to curve 208 approach their maximum output and can no longer contribute ink to compensate for the raster negatively biased according to curve 204. If too many input pixel levels in this uncorrectable range are present in image data corresponding to negatively biased missing rasters, malfunctioning inkjet compensation may not succeed. However, when negatively biased missing rasters are printed in a subsequent print pass or these biases are applied to swaths with all rasters working, placing input levels above the maximum correctable level in raster columns negatively biased according to curve 204 are used to conserves total swath density.

When swath rasters that are positively biased according to curve 208 approach maximum output levels, the raster in the swath negatively biased according to curve 204 is correspondingly increased to reach maximum output at the maximum input level. Positive and negative swath biases are designed so that at every input level the average perceived sum of the negatively biased rasters and all positively biased rasters in each swath matches the output density at every input level of a swath of working rasters un-modified according to curve 212. This density conservation, which also factors in the optional allowance for per-page post-rasterization compensation in the binary domain allow for uniform modification of all page pixels.

More concretely, in the 10-raster width swath example illustrated in FIG. 2 where nine of ten operative rasters per swath are biased according to positive curve 208 and one raster is biased according to the corresponding negative curve 204, the resulting average perceived density over each working raster swath is conserved for all input levels. This relationship is also true for reduced levels of bias for the positive/negative bias curve pairs illustrated in FIG. 2B including 228/224 and 238/234. As a result, when all rasters in a modified swath are operable, the perceived density of each biased swath is conserved from minimum to maximum input level. This enables operable inkjets in the printer that use the biased TRC curves to continue printing ink drops in high density regions of printed images beyond the maximum correctable density achievable in similarly biased swaths that include inoperative rasters.

During the process 100, the controller 80 applies the positively biased TRC 208 to the rasters in the swath around the first raster that corresponds to the inoperable inkjet. Using FIG. 3 as an example, the swath 308 includes a plurality of rasters that are arranged around the first raster 304. The controller 80 applies the TRC 208 with the positive bias to the contone image data in each of the rasters of the swath 308 other than the first raster 304. The remaining rasters in the swath 308 correspond to inkjets that neighbor the inoperable inkjet in the cross-process direction CP. The positive bias TRC 208 increases the contone density values for the neighboring rasters to be printed by operable inkjets to compensate for the streak image artifact that is produced by the first missing raster 304, which corresponds to an inoperable inkjet.

In another embodiment, the controller 80 applies different levels of modification to different rasters within each swath of the image data around the region corresponding to the inoperable inkjet. For example, in some configurations the controller 80 modifies the rasters in the swath that are immediate neighbors of the rasters corresponding to the inoperable inkjet with a reduced positive bias level or the controller 80 does not modify these neighboring rasters. The controller 80 may treat the rasters in the immediate vicinity of the inoperable inkjet differently to prevent a modification of the contone image data in the rasters that increases the density of the neighboring rasters to a point of saturation where additional missing inkjet compensation processes applied to the halftoned image data would be incapable of finding empty pixel locations in the region of halftoned image data surrounding the rasters of the inoperable inkjet. Additionally, the controller 80 optionally applies different TRCs with different positive bias levels, such as the TRCs 208, 228, and 238 of FIG. 2B, to different rasters within the swath to produce a gradual modification of the density levels in the contone image data within each swath. Multiple bias variations within each swath are possible as long as the perceived density over the resulting printed swath is sufficiently uniform.

Figure 3:
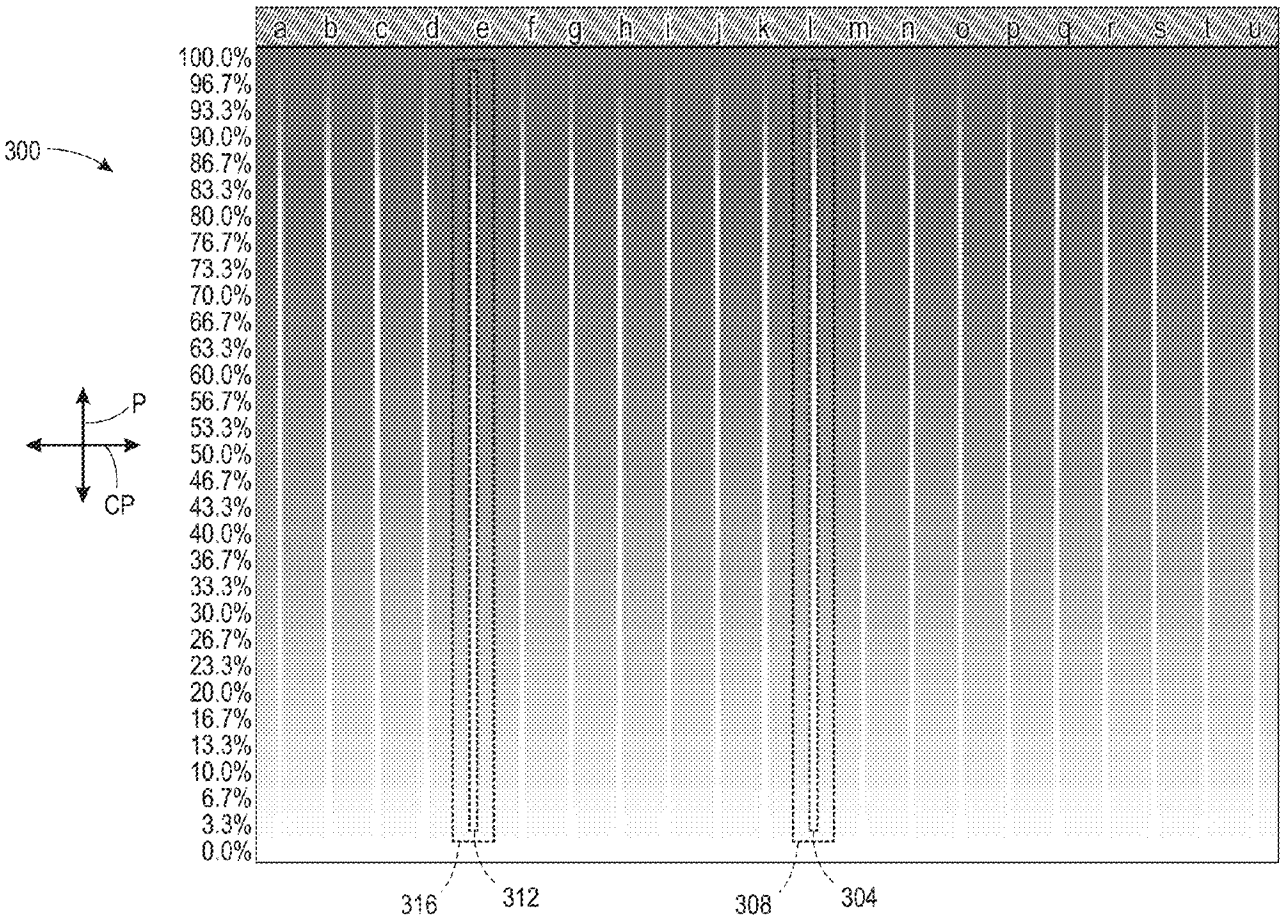
FIG. 3 is a diagram depicting sample image data including a plurality of swaths that are formed during the process of FIG. 1.

The process 100 continues as the controller 80 modifies additional swaths in the contone image data other than the first swath that corresponds to the inoperable inkjet using positively and negatively biased TRCs. In some embodiments of the process 100, the controller 80 uses TRCs with reduced levels of bias in the additional swaths of image data compared to the first swath (block 116). In embodiments where the controller 80 uses the same biased TRCs that are used in the first swath in the additional swaths of image data, the controller 80 proceeds to apply the same biased TRCs that are applied to the first swath of image data to additional swaths of image data over some or all of the remaining contone image (block 124). The controller 80 applies the first TRC 204 with the negative bias to a single raster within each swath and applies the second TRC 208 with the positive bias to each of the remaining rasters in the remaining swaths. For example, FIG. 3 depicts a series of additional swaths in the image 300 that include a single raster that is modified with the negative bias TRC 204 and with the remaining rasters being biased with the positive bias TRC 208. The swath 316 with a single raster 312 is one example of an additional swath of modified image data in the image 300. Those of skill in the art will recognize that in many situations the controller 80 applies the TRC with the negative bias to a raster of image data that corresponds to a completely operational inkjet that has not experienced any malfunction. Furthermore, the application of the positively biased TRC to the remaining rasters in the swath compensates for an inkjet that remains fully operational during the printing process. However, the process 100 applies the biased TRCs to multiple swaths of image data to provide a uniform representation of colors across the entire printed image instead of merely adjusting the rasters that neighbor an inoperable inkjet. The improved uniformity of the color representation produces a printed image with more uniform color reproduction compared to prior art inoperable inkjet compensation techniques.

Figure 4:
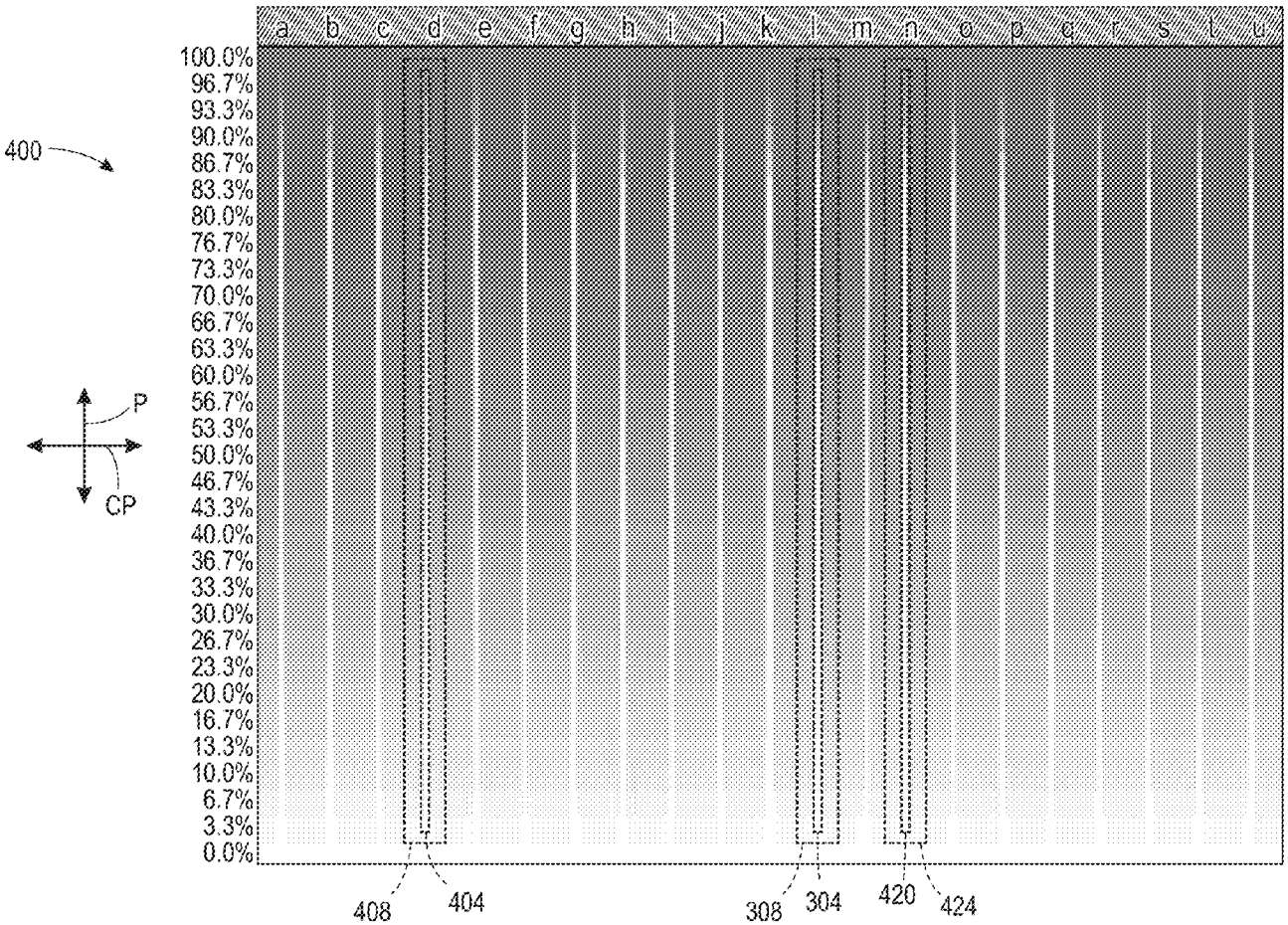
FIG. 4 is another diagram depicting sample image data including a plurality of swaths that are formed during the process of FIG. 1.

As noted above, in the process 100 the controller 80 applies the TRC with the negative bias to at least one raster in each swath of image data. In the example of FIG. 3, the controller 80 modifies the center raster in each swath using the TRC with the negative bias. However, in the embodiment of FIG. 4, the image 400 includes swaths that have variations in the position of the raster that the controller 80 modifies with the negatively biased TRC. For example, the swath 424 includes a raster 420 that is not located at the center of the swath along the cross-process direction axis CP. While not a requirement, the configuration of FIG. 4 may be more suitable in situations in which the controller 80 identifies more than one inoperable inkjet. In FIG. 4, the rasters 304 and 404 in swaths 308 and 408, respectively, each correspond to inoperable inkjets. Since the locations of the inoperable inkjets within more than one swath are often not completely centered, the controller 80 applies the TRC with the negative bias to different rasters within the remaining swaths to improve the overall uniformity of the image. In some configurations, the controller 80 applies the negative TRC to a single raster in each swath at random or applies the negative TRC to different rasters based on a predetermined pattern.

Figure 7:
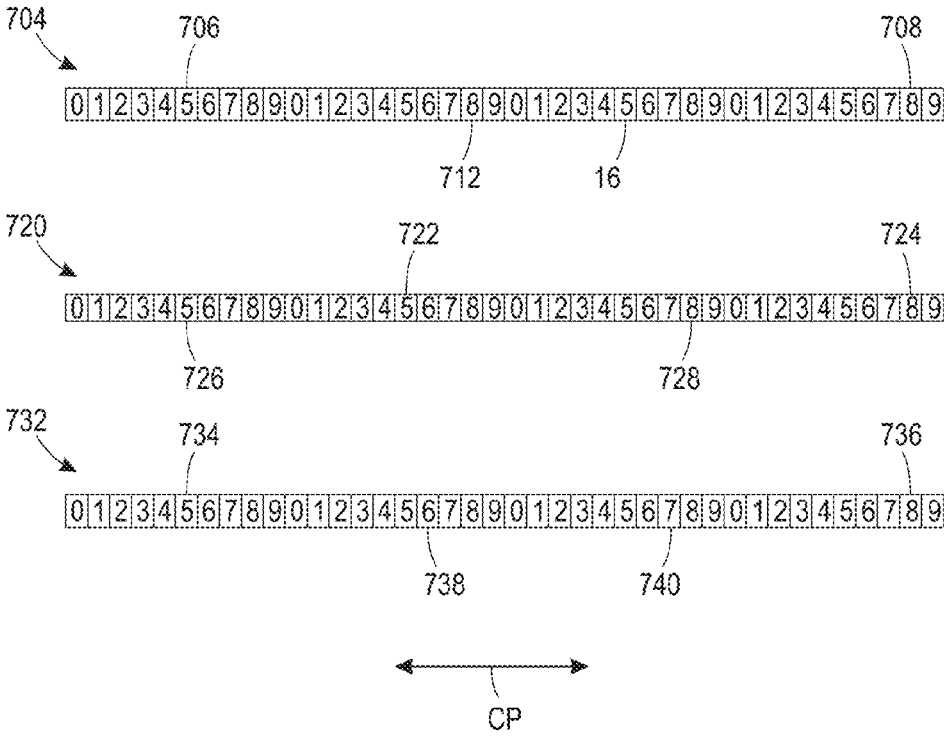
FIG. 7 is a diagram of various arrangements of columns in swaths that a printer modifies with biased TRCs to generate modified contone image data to compensate for multiple inoperable inkjets in the printer.
Figure 8:
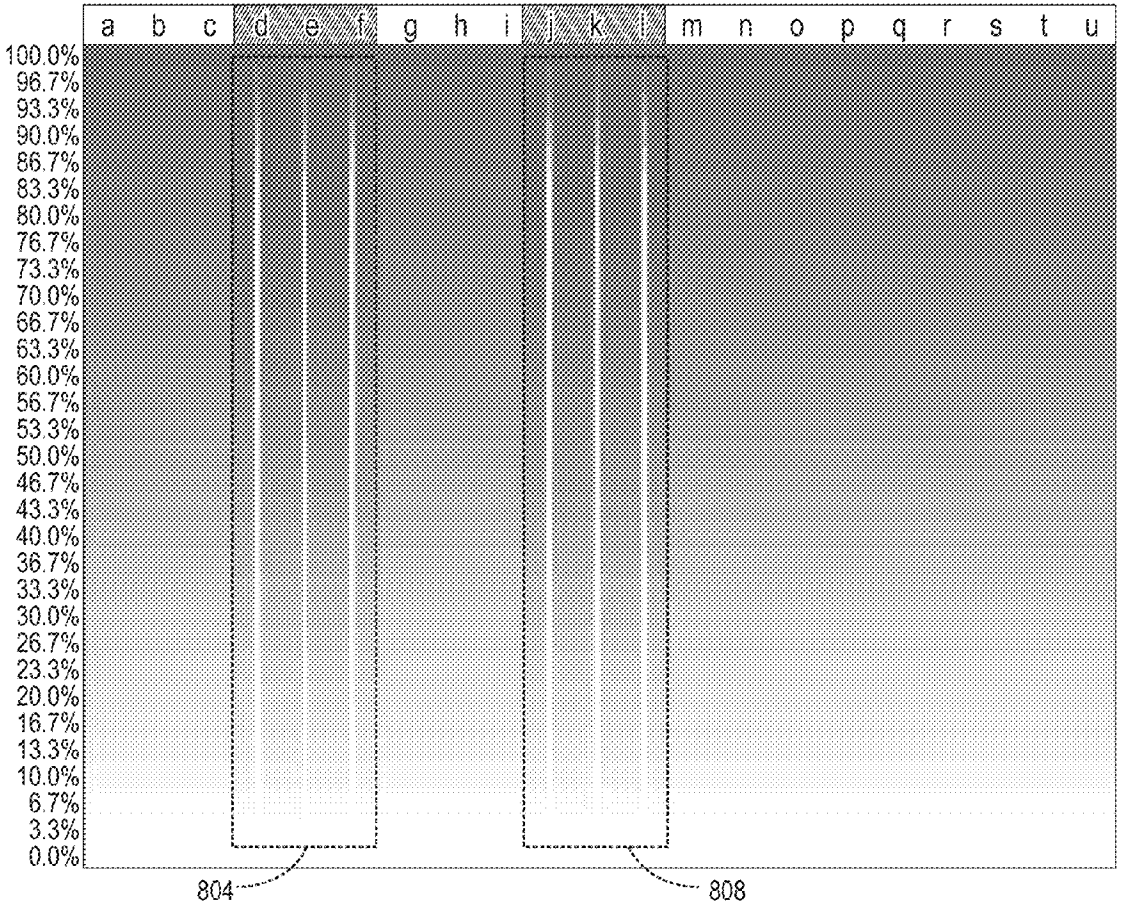
FIG. 8 PRIOR ART
FIG. 8 is a diagram depicting sample image data from a prior art compensation process for inoperable inkjets.

FIG. 7 depicts additional arrangements of pixel locations in image data that correspond to different swaths of the image data in situations where two inkjets correspond to inoperable ejectors. The examples of FIG. 7 each show four adjacent uniform width ten raster swaths in a single pass printer configuration where, each column corresponding to a different single inkjet. Similar arrangements are also applicable to multi-pass printers as long as the relative positions of the multiple interlaced rasters corresponding to each inoperative inkjet are biased accordingly. The sizes of swaths may also vary in different printer embodiments. Array 704 includes a series of swaths arranged along the cross-process direction CP. Array 704 includes the numeric index labels 0-9 for columns in each swath. In the array 704, the columns 706 (index 5) and 708 (index 8) each correspond to an inoperable inkjet. Each 10-raster swath in the array 704 includes a column that the printer 10 processes using a negatively biased TRC to reduce the perceptible impacts of the inoperable inkjets at locations 706 and 708. However, because the relative positions of the inoperable inkjets 706 and 708 are different within each swath (at indices 5 and 8, respectively) in the array 704 the printer 10 alternates the selection of the column for adjacent swaths to produce an alternating arrangement of selected columns in adjacent swaths. For example, in the array 704, the printer 10 selects the column 712 at index 8 and the column 716 at index 5 to produce an arrangement of swaths with column indices 5 and 8 being selected in alternating swaths.

In another configuration, the array 720 depicts columns 722 (index 5) and 724 (index 8) that correspond to two different inoperable inkjets. In the array 720, the printer 10 selects columns at index 5 in all swaths to the left of the swath including column 722, such as column 726, and selects columns at index 8, such as column 728, for all swaths to the right of the swath including the column 722. Of course, in another embodiment the printer 10 selects the columns in a right-to-left manner instead of left-to-right as depicted in the array 720.

In the array 732, the columns 734 (index 5) and 736 (column 8) correspond to inoperable inkjets. The printer 10 selects columns in the intermediate swaths between the swaths at locations 734 and 736 to produce a gradual transition between the swaths. For example, columns 738 and 740 are located in two intermediate swaths at indices 6 and 7, respectively. The configuration depicted in array 732 is one example of a technique that is suited to a single-pass printer where the inoperable inkjets only form a single streak in a single swath instead of forming repeated streaks at regular spatial frequencies in the printed image.

FIG. 3 and FIG. 4 depict examples of modifications to contone image data during process 100 where the controller 80 uses the same positively and negatively biased TRCs in multiple swaths of the image data. In other embodiments, the controller 80 applies TRCs with reduced levels of bias for different swaths of the image data (block 116). During process 100, the controller 80 selects or generates additional TRCs that have a reduced level of bias in comparison compared to the positively and negatively biased TRCs that are used in the first swath (block 120). For example, FIG. 2B depicts the TRCs 204 and 208 of FIG. 2A, but also includes additional TRCs with negative bias 224 and 234 and two additional TRCs with positive bias 228 and 238. In some embodiments, the controller 80 retrieves the TRCs 64 with reduced bias levels from the memory 84, while in other embodiments the controller 80 generates TRCs with reduced bias levels based on the TRCs 204 and 208 that the controller 80 uses to process the first swath containing the raster that corresponds to the inoperable inkjet.

Figure 5:
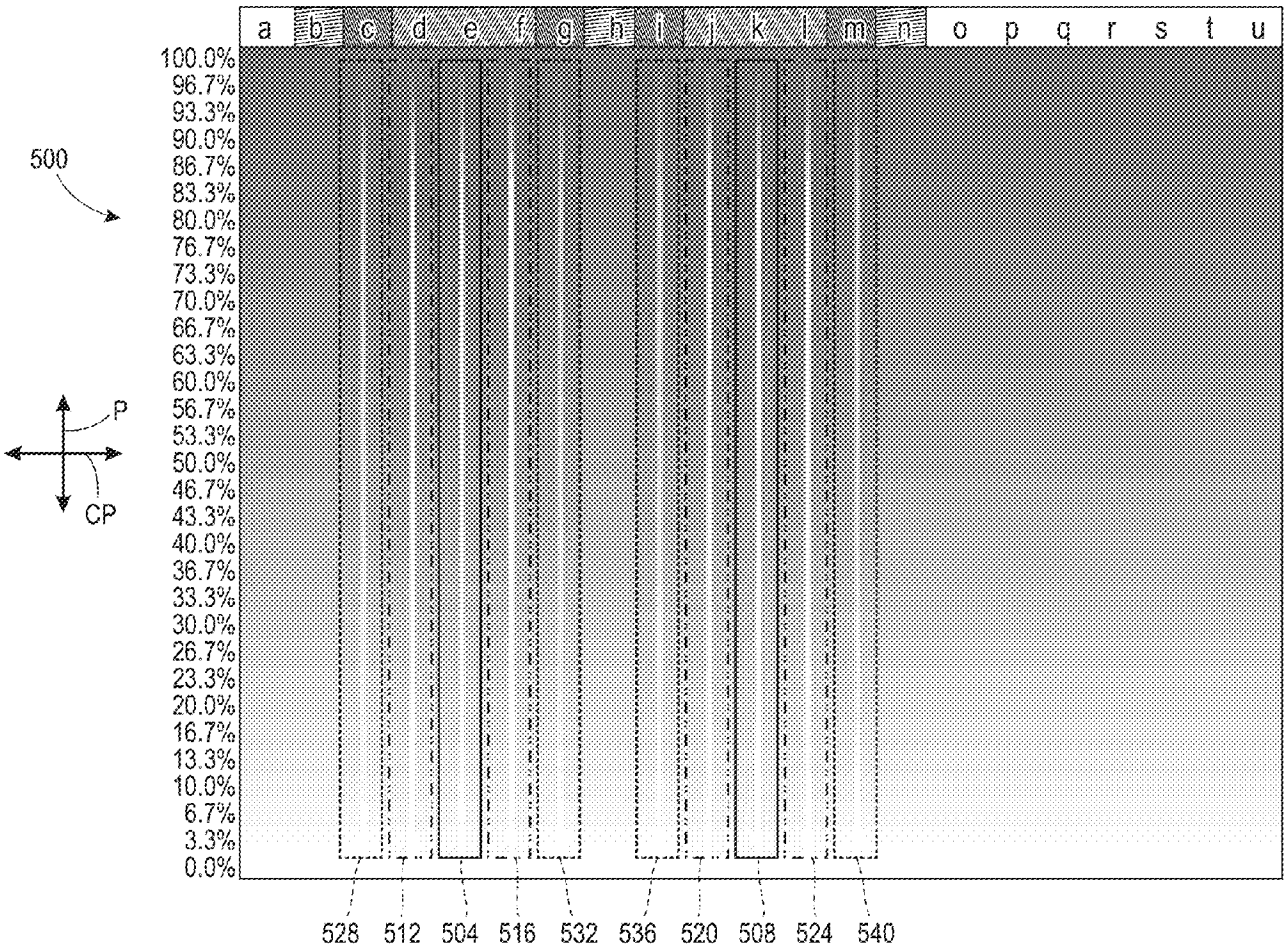
FIG. 5 is a diagram depicting sample image data include a plurality of swaths formed using TRCs with different bias levels during the process of FIG. 1.

During process 100, the controller 80 applies the TRCs with the reduced bias levels to swaths of the image data that surround the first swath containing the raster that corresponds to the defective inkjet (block 124). The controller 80 applies TRCs with gradually reduced bias levels to swaths that are located at a greater distance from the first swath along the cross-process direction axis CP. FIG. 5 depicts an example contone image 500 that includes two swaths 504 and 508 that correspond to locations of an inoperable inkjet in a multi-pass printed image. The controller 80 applies the TRCs 204 and 208 to the each of the swaths 504 and 508 as described above. During process 100, the controller 80 selects or generates the TRCs 224 and 228 with reduced bias levels to modify the neighboring swaths 512/516 and 520/524. The controller 80 selects or generates TRCs with even further reduced bias levels to modify the image data in the swaths 528/532 and 536/540 that lie further from the central swaths 504 and 508. In the embodiment of FIG. 5, the controller 80 does not modify swaths of image data that lie beyond a predetermined distance from the swaths that include the rasters that correspond to the inoperable inkjet. In the embodiment of FIG. 5, the controller 80 uses TRCs with reduced levels of bias to produce a gradual change in the intensity of changes to the contone image data from the locations of the inoperable inkjets to more remote portions of the image. The gradual change in contone levels results in a more gradual change in the distribution of binary pixels in the corresponding halftoned image data, which reduces the perceptible impact of the compensation for the inoperable inkjet in swaths 504 and 508. Of course, while FIG. 2B and FIG. 5 depict a scenario using a total of three sets of biased TRCs, alternative embodiments can use a greater or lesser number of biased TRCs with varying levels of bias. Those of skill in the art will recognize that many printers apply vector color transforms and additional TRCs other than the biased TRCs to contone image data during a printing operation. While the use of vector color transforms and conventional TRCs is not discussed in greater detail herein, those of skill in the art should recognize that the controller 80 applies the biased TRCs to contone image data after vector color transforms are applied and either prior to or after applying conventional TRCs during a printing process. Those of skill in the art will further understand that the order of TRC application will alter the specific curves required to produce density conservation.

The processing described above with reference to blocks 116-128 continues for additional swaths in the contone image data until there are no additional swaths of image data to be processed (block 128). The printer 10 then generates halftoned image data with reference to the swaths of modified contone image data (block 132). In the process 100, the controller 80 generates the halftoned image data based on the modified contone image data instead of the original contone image data, but the halftoning process is otherwise known to the art and is not discussed in further detail herein. Those of skill in the art familiar with compensation techniques for missing inkjets that occur after the controller generates halftoned image data should recognize that existing techniques for missing inkjet compensation using halftoned image data are suitable for use with halftoned image data that the printer generates from the adjusted swaths of contone image data that are generated during the process 100 (block 136). These halftoned missing inkjet compensation techniques are not described in further detail herein.

Process 100 continues as the printer 10 operates the inkjets in one or more printheads in the marking unit 11 to form a printed image based on the halftoned image data (block 140). In the embodiment of FIG. 6, the actuator 56 rotates the imaging drum 8 past the inkjets in the marking unit 11 during one or more passes and the controller 80 generates electrical firing signals to control the operation of the inkjets to form a printed image on the surface of the drum. The marking unit 11 translates in the cross-process direction between passes to form an interleaved printed image on the drum 8. The transfix roller actuator 58 moves the transfix roller 22 into engagement with the drum 8 to form a nip 32, and a sheet of paper or other suitable print medium passes through the nip 31. The latent ink image on the surface of the drum 8 is transferred and fixed to the media sheet in the nip 31.

It will be appreciated that variants of the above disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A method of producing a printed image comprising:

identifying with a controller an inoperable inkjet in a printhead;

identifying with the controller a first raster in image data corresponding to the inoperable inkjet in the printhead;

applying with the controller a first modification to the image data in a first swath of the image data to generate a first modified swath in the image data to compensate for the inoperable inkjet in a printed image, the first swath including the first raster corresponding to the inoperable inkjet and a plurality of rasters in a region of the image data around the first raster, the application of the first modification further comprising:

applying with the controller a first tone reproduction curve (TRC) to the first raster corresponding to the inoperable inkjet; and applying with the controller a second TRC to a plurality of rasters in the first swath not including the first raster;

applying with the controller a plurality of modifications to each swath in a plurality of swaths in the image data to generate a plurality of modified swaths in the image data, each swath in the plurality of swaths including a plurality of rasters that do not include the raster corresponding to the inoperable inkjet; and operating with the controller a plurality of inkjets in the printhead with reference to the image data including the first modified swath and the plurality of modified swaths to form a printed image on an image receiving surface.

2. The method of claim 1, the application of the first TRC to the first raster further comprising:

applying with the controller the first TRC having a negative bias to the first raster corresponding to the inoperable inkjet; and the application of the second TRC to the plurality of rasters in the first swath further comprising:

applying with the controller the second TRC having a positive bias to each raster in the plurality of rasters in the first swath not including the first raster.

3. The method of claim 1, the application with the controller of the modification in the plurality of modifications to at least one swath in the plurality of swaths further comprising:

applying with the controller the first TRC to a second raster in the at least one swath located at a relative position in the at least one swath that corresponds to the first raster corresponding to the inoperable inkjet in the first swath; and applying with the controller the second TRC to a plurality of rasters in the at least one swath not including the second raster.

4. The method of claim 3 wherein the first raster corresponding to the inoperable inkjet in the first swath and the second raster in the at least one swath is located at a center of the first swath and the at least one swath, respectively, in a cross-process direction.

5. The method of claim 1, the application with the controller of the first modification to at least one swath in the plurality of swaths further comprising:

applying with the controller the first TRC to a second raster in the at least one swath located at a relative position in the at least one swath that differs from another relative position of the first raster corresponding to the inoperable inkjet in the first swath; and applying with the controller the second TRC to a plurality of rasters in the at least one swath not including the second raster.

6. The method of claim 1, the application of the first modification to the first swath in the image data and the application of the plurality of modifications to at least one swath in the plurality of swaths comprising:

applying with the controller the first tone reproduction curve (TRC) having a first bias level to the first raster corresponding to the inoperable inkjet, the first bias level being a negative bias level; and applying with the controller the second TRC having a second bias level to the plurality of rasters in the first swath not including the first raster, the second bias level being a positive bias level;

applying with the controller a third TRC having a third bias level to a second raster in the at least one swath, the third bias level being a negative bias level that is less than the first bias level; and applying with the controller a fourth TRC having a fourth bias level to a plurality of rasters in the at least one swath not including the second raster, the fourth bias level being a positive bias level that is less than the second bias level.

7. The method of claim 1 further comprising:

generating with the controller halftoned image data with reference to the image data including the first modified swath and the plurality of modified swaths; and operating with the controller the plurality of inkjets in the printhead with reference to the halftoned image data to form the printed image on the image receiving surface.

8. An inkjet printer comprising:

at least one printhead including a plurality of inkjets;

an image receiving member having an image receiving surface configured to receive ink ejected from the plurality of inkjets in the at least one printhead;

a memory configured to store:

image data corresponding to an image to be printed on the image receiving member; and a plurality of tone reproduction curves (TRCs); and a controller operatively connected to the at least one printhead and the memory, the controller being configured to:

identify an inoperable inkjet in the plurality of inkjets in the at least one printhead;

identify a first raster in the image data stored in the memory corresponding to the inoperable inkjet in the printhead;

apply a first modification to the image data in a first swath of the image data to generate a first modified swath in the image data to compensate for the inoperable inkjet in a printed image, the first swath including the first raster corresponding to the inoperable inkjet and a plurality of rasters in a region of the image data around the first raster, the controller being further configured to:

apply a first TRC in the plurality of TRCs stored in the memory to the first raster corresponding to the inoperable inkjet; and apply a second TRC in the plurality of TRCs stored in the memory to a plurality of rasters in the first swath not including the first raster;

apply a plurality of modifications to each swath in a plurality of swaths in the image data to generate a plurality of modified swaths in the image data, each swath in the plurality of swaths including a plurality of rasters that do not include the raster corresponding to the inoperable inkjet; and operate a plurality of inkjets in the printhead with reference to the image data including the first modified swath and the plurality of modified swaths to form a printed image on the image receiving surface.

9. The inkjet printer of claim 8, the controller being further configured to:

apply the first TRC having a negative bias to the first raster corresponding to the inoperable inkjet; and apply the second TRC having a positive bias to each raster in the plurality of rasters in the first swath not including the first raster.

10. The inkjet printer of claim 8, the controller being further configured to:

apply the first TRC to a second raster in at least one swath in the plurality of swaths located at a relative position in the at least one swath that corresponds to the first raster corresponding to the inoperable inkjet in the first swath; and apply the second TRC to a plurality of rasters in the at least one swath not including the second raster.

11. The inkjet printer of claim 10 wherein the first raster corresponding to the inoperable inkjet in the first swath and the second raster in the at least one swath are located at a center of the first swath and at least one swath, respectively, in a cross-process direction.

12. The inkjet printer of claim 8, the controller being further configured to:

apply the first TRC to a second raster in at least one swath in the plurality of swaths located at a relative position in the at least one swath that differs from another relative position of the first raster corresponding to the inoperable inkjet in the first swath; and apply the second TRC to a plurality of rasters in the at least one swath not including the second raster.

13. The inkjet printer of claim 8, the controller being further configured to:

apply the first TRC in the plurality of TRCs stored in the memory having a first bias level to the first raster corresponding to the inoperable inkjet, the first bias level being a negative bias level; and apply the second TRC in the plurality of TRCs stored in the memory having a second bias level to the plurality of rasters in the first swath not including the first raster, the second bias level being a positive bias level;

apply a third TRC in the plurality of TRCs stored in the memory having a third bias level to a second raster in at least one swath in the plurality of swaths, the third bias level being another negative bias level that is less than the first bias level; and apply a fourth TRC in the plurality of TRCs stored in the memory having a fourth bias level to a plurality of rasters in the at least one swath not including the second raster, the fourth bias level being another positive bias level that is less than the second bias level.

14. The inkjet printer of claim 8, the controller being further configured to:

generate halftoned image data with reference to the image data including the first modified swath and the plurality of modified swaths; and operate the plurality of inkjets in the printhead with reference to the halftoned image data to form the printed image on the image receiving surface.

* * * * *